US006839928B1

(12) United States Patent
Woodall et al.

(10) Patent No.: US 6,839,928 B1
(45) Date of Patent: Jan. 11, 2005

(54) SEAT CUSHION WITH INTEGRATED HANDLE

(75) Inventors: Cathleen Woodall, Aliso Viejo, CA (US); Jason S. Langston, Aliso Viejo, CA (US); Paul M. Yates, La Canada, CA (US)

(73) Assignee: Gelco Products, LLC, Aliso Viejo, CA (US)

( * ) Notice: Subject to any disclaimer, the term of this patent is extended or adjusted under 35 U.S.C. 154(b) by 0 days.

(21) Appl. No.: 10/073,370

(22) Filed: Feb. 5, 2002

(51) Int. Cl.[7] ..... A47C 20/02; B68G 5/00
(52) U.S. Cl. ..... 5/653; 5/656
(58) Field of Search ..... 5/653, 656; 297/4, 297/219.11, 219.1

(56) References Cited

U.S. PATENT DOCUMENTS

| | | | | | |
|---|---|---|---|---|---|
| 679,915 | A | * | 8/1901 | Rudolf | 5/653 |
| 2,061,664 | A | | 11/1936 | Loncoln | |
| 2,156,629 | A | * | 5/1939 | Hutchison | 297/452.25 |
| 2,765,480 | A | * | 10/1956 | Mueller | 5/640 |
| 3,112,956 | A | | 12/1963 | Schick et al. | |
| 3,323,151 | A | | 6/1967 | Lerman | |
| 3,629,901 | A | * | 12/1971 | Wolf et al. | 16/227 |
| 3,747,977 | A | * | 7/1973 | Rowland | 297/452.16 |
| 4,031,578 | A | * | 6/1977 | Sweeney et al. | 5/426 |
| 4,190,918 | A | | 3/1980 | Harvell | |
| 4,345,345 | A | * | 8/1982 | Holtz | 5/640 |
| 4,506,396 | A | * | 3/1985 | Ritchie et al. | 5/631 |
| 4,597,605 | A | * | 7/1986 | Gilbert | 297/228.1 |
| 4,643,481 | A | * | 2/1987 | Saloff et al. | 297/452.25 |
| 4,871,209 | A | * | 10/1989 | Handelman | 297/378.1 |
| 4,925,064 | A | * | 5/1990 | Comora | 224/155 |
| 4,925,241 | A | * | 5/1990 | Geraci | 297/229 |
| 5,273,510 | A | * | 12/1993 | Puckett et al. | 482/142 |
| 5,297,848 | A | * | 3/1994 | Grinnell | 287/219.1 |
| 5,421,637 | A | * | 6/1995 | Lemburg | 297/188.01 |
| 5,544,377 | A | * | 8/1996 | Gostine | 5/630 |
| 5,611,098 | A | * | 3/1997 | Skibik | 5/653 |
| 5,855,415 | A | | 1/1999 | Lilley, Jr. | |
| 6,142,573 | A | * | 11/2000 | Harding et al. | 297/452.25 |
| 6,347,421 | B1 | * | 2/2002 | D'Emilio | 5/636 |

* cited by examiner

*Primary Examiner*—Robert J. Sandy
*Assistant Examiner*—Thomas Ho
(74) *Attorney, Agent, or Firm*—Walter A. Hackler

(57) ABSTRACT

A seat cushion includes a pair of generally flat pads for supporting a user's buttocks and a handle disposed between the pads for carrying the seat cushion. Arms, interconnecting the pads and the handle are provided for holding the pads in both a spaced apart relationship and enabling grasping of the handle by a user. The arms are flexible for enabling the pads to be oriented in both a planar relationship for supporting the user's buttocks and a coplanar relationship for enabling transport of the seat cushion by the handle.

10 Claims, 3 Drawing Sheets

SEAT CUSHION WITH INTEGRATED HANDLE

The present invention is generally related to cushions, and more particularly, to a portable cushion which provides for supporting a user's ischii while preventing pressure on the user's coccyx.

Portable cushion are often utilized by individuals to increase the comfort of bleachers, benches and other hard frame seats or the like. This is particularly the case for sports enthusiasts which attend indoor and outdoor sporting events.

Many prior art portable cushions have incorporated various handles or other carrying arrangements, and many include both seat and back support.

However, most prior art cushions have not been configured for supporting the user's buttocks, or ischii without causing pressure to the coccyx.

The present invention provides for a portable cushion with an integral handle for enabling hand carrying of the cushion while at the same time providing a cushion for extended seating without causing uncomfortable pressure to the user's coccyx.

SUMMARY OF THE INVENTION

A seat cushion in accordance with the present invention generally includes a pair of generally flat pads for supporting a user's buttocks and a hinged handle disposed between the pads for carrying said seat cushion.

Arms, interconnecting the pads and said hinged handle, are provided for holding the pads in a spaced apart relationship and enabling grasping of said hinged handle by the user. The arms are of sufficient flexibility for enabling the pads to be oriented in both a planar relationship for supporting the user's buttocks and a parallel planer relationship for enabling transport of said seat cushion by the hinged handle.

More particularly, the hinged handle and arms are recessed from a top of each of the pads for enabling the user's coccyx to depend between the pads in order to prevent pressure on the coccyx. Preferably the pads, arms and hinged handle are integrally molded, however the handle and arms may be separately attached.

More specifically, the arms include forearms and aftarms each joined to opposite ends of said hinged handle and each of the pads include an arcuate forward perimeter, the forward perimeters been joined by the forearms.

In addition, each of the pads may include an arcuate rearward perimeter, the rearward perimeter being joined by the aftarms.

In order to facilitate portability means may be provided for releasably holding the pads in the parallel plane relationship.

In an alternate embodiment of the present invention, a pair of generally flat pads are provided for supporting a user's buttocks and a web may interconnect the pads for holding the pads in the spaced apart relationship. The web is flexible for enabling the pads to be oriented in both a planar relationship for supporting the user's buttocks and a coplanar relationship for enabling the transport of the seat cushion. A handle is attached to the web for carrying the pads in the coplanar relationship.

As in the hereinabove described embodiment, the web and handles are recessed from the top of the pads for enabling the user's coccyx to depend between the pads in order to prevent pressure thereon. The handle may be integrally molded into the web or separately attached thereto.

Each of the pads may include an arcuate forward perimeter with the forward perimeters being joined by the web. In addition, the pads may include an arcuate rearward perimeter with the rearward perimeters being joined by the web. In addition, the seat cushion also may comprise means for releasably holding the pads in the coplanar relationship to facilitate transport thereof.

BRIEF DESCRIPTION OF THE DRAWINGS

The foregoing, and further more specific objects and advantages of the present invention will be come readily apparent to those skilled in the art from the following detailed description when taken in conjunction with the following drawings, in which.

DETAILED DESCRIPTION

Figure 1:
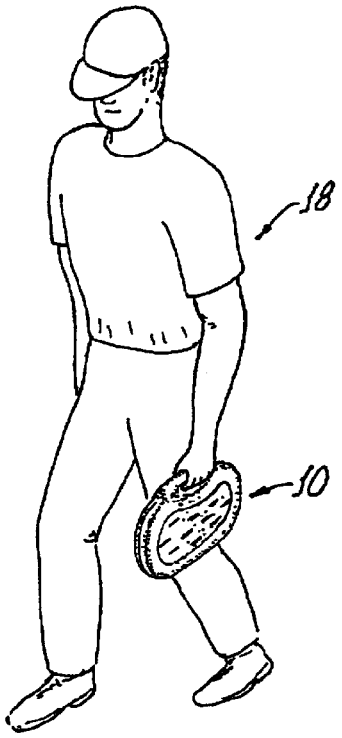
FIG. 1 is a pictorial representation showing the seat cushion in accordance with the present invention with two pads disposed in a parallel plane relationship for enabling easy transport by a fan.
Figure 2:
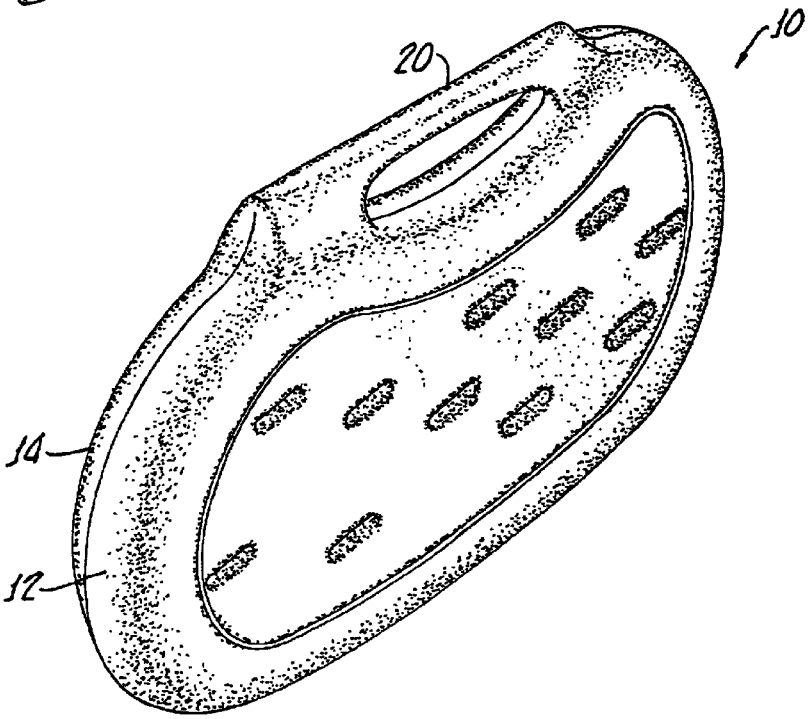
FIG. 2 is a perspective view of the seat cushion in accordance with the present invention with the two generally flat pads for supporting a user's buttocks shown in a parallel plane relationship.
Figure 3:
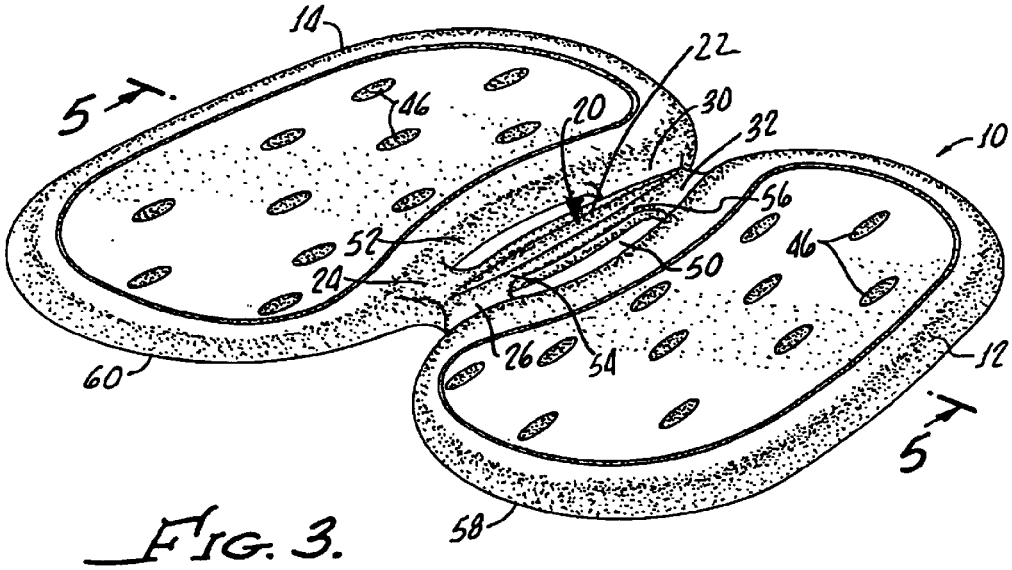
FIG. 3 is a perspective view of the seat cushion in accordance with the present invention in which the pads are disposed in a generally planar relationship for enabling placement on a seat, or the like, and enabling support of a user's buttocks.

With reference to FIGS. 1 and 2, there is shown a seat cushion 10 in accordance with the present invention which generally includes a pair of generally flat pads 12, 14, shown oriented in a parallel plane relationship for enabling transport of the seat cushion by a user, such as a sports fan 18, by a hinged handle 20 disposed between the pads 12, 14, the handle 20 having a hinge 22 molded therein, see FIG. 3.

With reference to FIG. 3, the seat cushion 10 is shown with the pads 12, 14 oriented in a planar relationship for supporting a user's left and right ischii and gluteal prominences, or buttocks, not shown.

More particularly, forearms 24, 26 and aft arms 30, 32 interconnect the pads 12, 14 and hinged handle 20 with the pads held in a spaced apart relationship for enabling grasping of the hinged handle 20 by the user. The arms 24, 26, 30, 32 are flexible for enabling the pads 12, 14 to be oriented in both a planar relationship, as shown in FIG. 3 for supporting the user's buttocks and a parallel plane relationship, shown in FIGS. 1 and 2, for enabling transport of the seat cushion 10 by the hinged handle 20.

Figure 4:
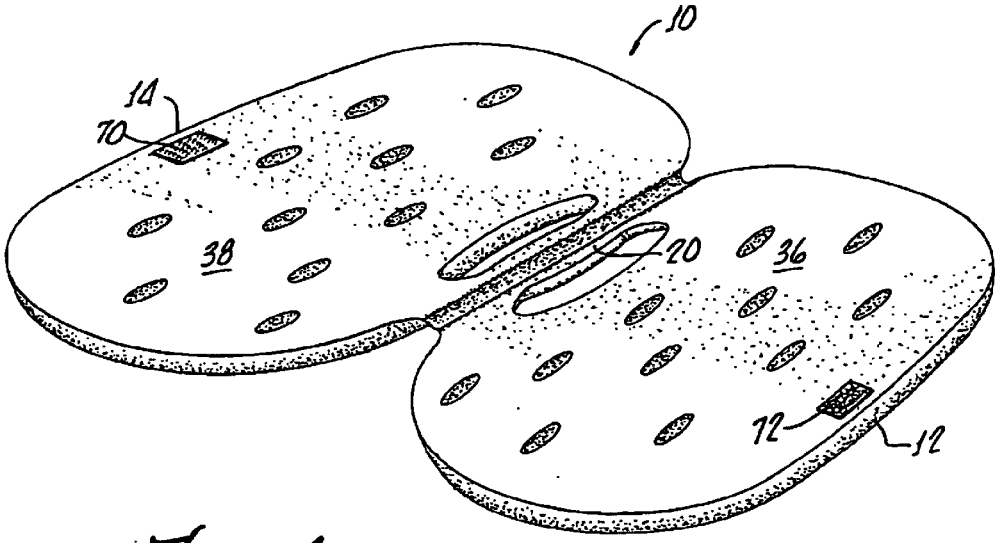
FIG. 4 is a perspective view of a bottom of a seat cushion in accordance with the present invention.

FIG. 4 shows pad undersides which may be treated or coated with a non-slip material to prevent movement of the cushion on a seat or bench during use by the user 18, not shown in FIG. 4.

Figure 5:
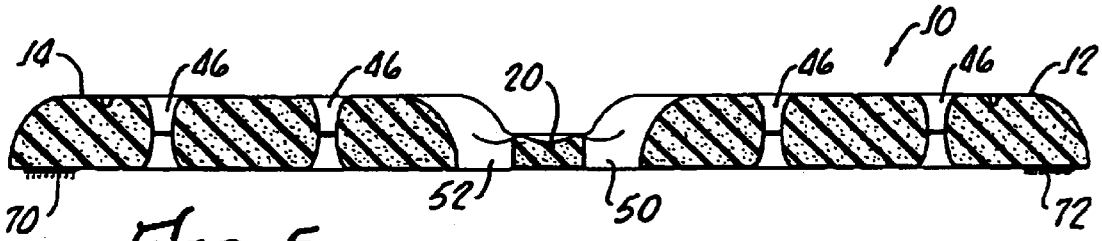
FIG. 5 is a cross-sectional view of the seat cushion in accordance with the present invention taken along line 5-5 of FIG. 4 showing a recess between the pads for enhancing the comfort of a user and slots in the pads for allowing the cushion to breath.

As shown in FIG. 3, and more clearly in FIG. 5, the arms 24, 26, 30, 32 are recessed from a top 42, 44 of pads 12, 14 respectively for enabling the user's coccyx (not shown) to depend between the pads 22, 14 in order to prevent pressure on the coccyx, not shown. The hinged handle 20 is also recessed and the pads, arms and hinged handle may be integrally molded.

In that regard, the pads 12, 14 may be molded and formed in any conventional manner with or without coverings, not shown. Any suitable foam, gel or combination thereof may be utilized in the formation of the pads 12, 14.

To enable breathing of the cushion dimples or slots 46, maybe dispersed throughout the pad 12, 14 areas in a conventional manner.

In order to provide spacings 50, 52 on both sides of the handle for enabling grasping thereof by the user, the forearms 20, 24 and aftarms 30, 32 are joined to opposite ends 54, 56 of the handle 20.

Preferably, each of the pads 12, 14 include an arcuate forward perimeter 58, 60 which are joined by the forearms 24, 26. This structure enables a comfortable seating for the user as well as streamlining the cushion 10 for transport.

Similarly, the pads 12, 14 include arcuate rearward perimeters 64, 66 which are joined by the aftarms 30, 32. This further streamlines the cushion 10 for transport thereof. In that regard, with reference to, FIG. 4, a Velcro® type hook patch 70 and loop patch 72 providing means for releasable holding the pads 12, 14 in a coplanar relationship as shown in FIGS. 1 and 2. Other structure may be utilized to releasable hold the pads 12, 14 in the coplanar relationship, such as, snaps or loops, tags or the like.

Figure 6:
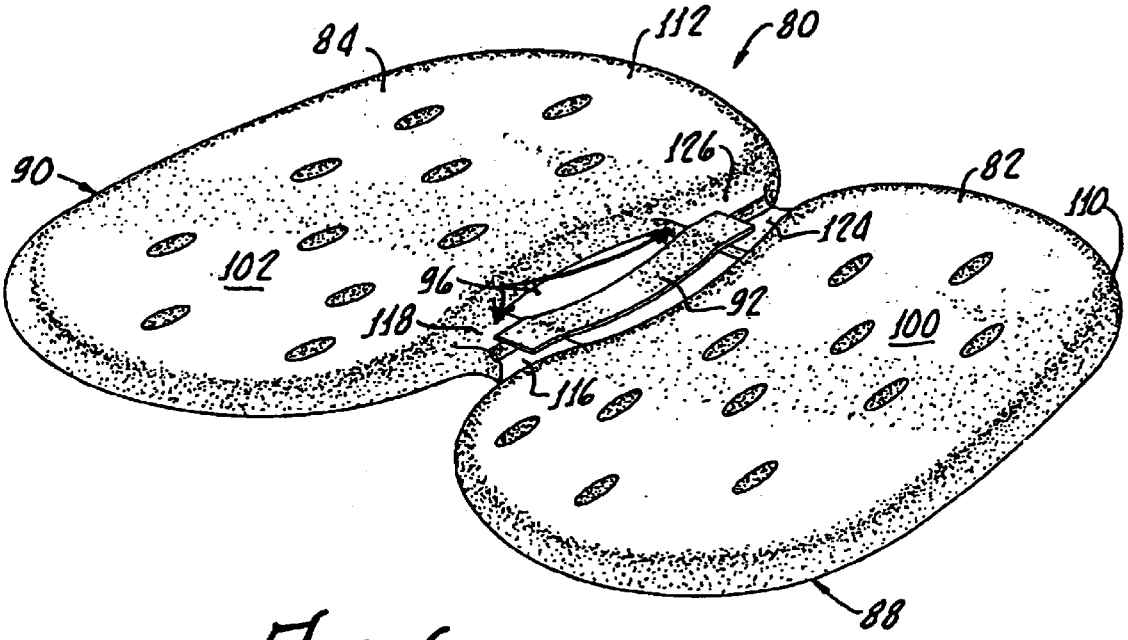
FIG. 6 is a perspective view of an alternative embodiment of the present invention in which two pads of the cushion are interconnected by a web with a handle molded or attached thereto for carrying the cushion in a manner as shown in FIG. 1.

With reference to FIG. 6 there is shown an alternative embodiment 80 which also includes a pair of generally flat pads 82, 84 for supporting a user's buttocks, each pad 82, 84 having mirror image perimeters 88, 90, a handle 92 is disposed between the pads 82, 84 for carrying the seat cushion 80 in a manner shown with regard to the cushion 10 in FIG. 1. The handle 92 may be molded with or separately attached to a web 96 interconnecting the pads 82, 84 which holds the pads 82, 84 in a spaced apart relationship. The web 96 is flexible for enabling the pads 82, 84 to be oriented in both a planar relationship for supporting the user's buttocks as shown in FIG. 6 and a coplanar relationship for enabling transport of the seat cushion 80 as illustrated in FIGS. 1 and 2 and described in conjunction with the seat cushion embodiment 10.

As shown in FIG. 6, the web 96 and handle 92 are recessed from a top 100, 102 of the pads 82, 84. This structure, is similar to that of the cushion 10 hereinabove described and provides for support of the user's buttocks (not shown) by the pads 82, 84 and enabling the user's coccyx to depend between the pads 82, 84 in order to prevent pressure on the coccyx (not shown).

The web 96 may include forearms 116, 118 attached to one end 120 of the handle and rear arms 124, 126 attached to another end 130 of the handle 92.

As hereinabove noted, the handle 92, web 96 pads 82, 84 may be integrally molded, however, the handle 92, may be separately attached to the web 96, by sewing or any similar attachment method. Alternatively, the web 96 may be eliminated and the handle attached directly to forearms 116, 118 and aftarm 124, 126 as shown.

Similar to the cushion 10, each of the pads 82, 84 may include arcuate forward perimeters 106, 108 and rearward perimeters 110, 112, which are joined by the web 96.

Alternatively, the web 96 may be continuous with the flexible handle 92 extendable therefrom to provide grasping thereof by the user, the user's fingers, not shown, passing between the handle 92 and the web 96.

While the hereinabove described seat cushion has been described with reference to specific embodiments, it is to be clearly understood by those skilled in the art that the invention is not limited thereto. Rather, the scope of the invention is to be interpreted in conjunction with the appended claims.

What is claimed is:

1. A seat cushion comprising: a pair of generally flat pads for supporting a user's buttocks; a hinged handle disposed between the pads for carrying said seat cushion; spaced apart arms, attached to and extending from the pads and said hinged handle, for holding the pads and handle in a spaced apart relationship and enabling grasping of said hinged handle by the user, said arms being flexible for enabling the pads to be oriented in both a planar relationship for supporting the user's buttocks and a folded parallel plane relationship for enabling transport of said seat cushion by the handle, the arms including forearms and aftarms each joined to opposite ends of said hinged handle for holding said hinged handle in a spaced apart relationship with the folded pads; and wherein the pads, arms and hinged handle are integrally molded.

2. The seat cushion according to claim 1 wherein said hinged handle and said arms are recessed from a top of each of the pads for enabling the user's coccyx to depend between the pads in order to prevent pressure on the coccyx.

3. The seat cushion according to claim 1 wherein each of the pads include an arcuate forward perimeter, the forward perimeters being joined by the forearms.

4. The seat cushion according to claim 3, wherein each of the pads include an arcuate rearward perimeter, the rearward perimeter being joined by the aftarms.

5. The seat cushion according to claim 2 further comprising means for releasably holding the pads in the parallel planer relationship.

6. A seat cushion comprising: a pair of generally flat pads for supporting a user's buttocks, the pads having mirror image perimeters; a single hinged handle disposed between the pads for carrying said seat cushion; spaced apart arms, attached to and extending from the pads and said hinged handle, for holding the pads and handle in a spaced apart relationship and enabling grasping of said hinged handle by the user, the arms being flexible for enabling the pads to be oriented in both a planar relationship for supporting the user's buttocks and a folded parallel plane relationship for enabling transport of said seat cushion by the hinged handle, the arms including forearms and aftarms each joined to opposite ends of said hinged handle for holding said hinged handle in a spaced apart relationship with the folded pads; and wherein the pads, arms and hinged handle are integrally molded.

7. The seat cushion according to claim 6, wherein said hinged handle and arms have a thickness smaller than a thickness of the pads and are disposed between the pads for enabling the user's coccyx to depend between the pads in order to prevent pressure on the coccyx.

8. The seat cushion according to claim 7 wherein the handle arms and pads each have a bottom surface disposed in a single plane with the pads oriented for supporting the user's buttocks.

9. The seat cushion according to claim 6 wherein each of the pads include an arcuate forward perimeter, the forward perimeters being joined by the forearms.

10. The seat cushion according to claim 9 wherein each of the pads include an arcuate rearward perimeter, the rearward perimeter being joined by the aftarms.

* * * * *